US006764370B2

(12) United States Patent
Bitton

(10) Patent No.: US 6,764,370 B2
(45) **Date of Patent: *Jul. 20, 2004**

(54) BUBBLE WAND WITH ORNAMENTS WITHIN A CONTAINER

(76) Inventor: Mary Kay Bitton, 467 Burano Ct., Oak Park, CA (US) 91377

( * ) Notice: Subject to any disclaimer, the term of this patent is extended or adjusted under 35 U.S.C. 154(b) by 0 days.

This patent is subject to a terminal disclaimer.

(21) Appl. No.: 10/663,185

(22) Filed: Sep. 16, 2003

(65) Prior Publication Data

US 2004/0082254 A1 Apr. 29, 2004

Related U.S. Application Data

(63) Continuation of application No. 10/128,889, filed on Apr. 23, 2002, now Pat. No. 6,620,017.

(51) Int. Cl.[7] ..... A63H 33/28

(52) U.S. Cl. ..... 446/16; 446/15; 446/18; 206/229

(58) Field of Search ..... 446/15, 16, 18, 446/21; 215/389, 231; 220/376; D21/401, 402; 206/229, 457

(56) References Cited

U.S. PATENT DOCUMENTS

| | | | | | |
|---|---|---|---|---|---|
| 3,818,627 | A | * | 6/1974 | Lebensfeld | 446/15 |
| 5,653,620 | A | * | 8/1997 | Lin | 446/15 |
| 5,915,600 | A | | 6/1999 | Bitton | 222/464.1 |
| D423,581 | S | * | 4/2000 | Schimmel | D19/57 |
| D428,067 | S | * | 7/2000 | Kort | D21/401 |
| 6,132,125 | A | * | 10/2000 | Lin | 401/195 |
| 6,135,842 | A | | 10/2000 | LaFata | 446/15 |
| 6,200,184 | B1 | | 3/2001 | Rich et al. | 446/15 |
| 6,386,935 | B1 | * | 5/2002 | Lin | 446/16 |
| 6,547,621 | B1 | * | 4/2003 | Cameron | 446/15 |

* cited by examiner

*Primary Examiner*—Derris H. Banks
*Assistant Examiner*—Bena B. Miller
(74) *Attorney, Agent, or Firm*—K. David Crockett, Esq.; Crockett & Crockett

(57) ABSTRACT

A bubble wand with an ornamental figure and an ornamental bubble loop. The ornamental figure and ornamental loop are provided in the form of beads, shapes, letters, a small figurine of an animal, plant, person, cartoon character, action figure, or other attractive representation. The ornamental figure and loop are attached to the wand or are provided with a means for releasably or slidably attaching the ornamental figure to the wand or to a suction tube used in many soap dispensers.

12 Claims, 4 Drawing Sheets

BUBBLE WAND WITH ORNAMENTS WITHIN A CONTAINER

This application is a continuation of U.S. application Ser. No. 10/128,889, filed Apr. 23, 2002, now U.S. Pat. No. 6,620,017.

FIELD OF THE INVENTIONS

This invention relates to ornaments attached to bubble wands within containers.

BACKGROUND OF THE INVENTIONS

Bubble wands have traditionally been relatively simple plastic wands with one or two rings attached. The wand is typically placed loose inside the bubble mixture container so that a child must put his or her fingers into a bubble mixture to retrieve the wand. Furthermore, a child can easily lose the wand once the wand is separated from the container. This frustrates the child, makes the bubble mixture less entertaining to use, and can frustrate a parent who must spend time looking for a lost wand. In addition, although the market for bubble wands is large, continued sales volume depends on innovative designs, inventions, and marketing techniques for bubble wands. Thus, new bubble wand toys are needed.

SUMMARY

The devices and methods described below provide for mounting three-dimensional or two-dimensional art onto a bubble wand that is within a transparent container. The ornamental figure attached to the bubble wand can be used to provide amusement to children, as a means to make finding lost bubble wands easier, as a method of inducing children to bathe longer, as an inducement for both children and adults to use more soap or more bubble mixture, as an advertising medium and tie-in for commercial exploitation of characters, as a promotional item for various events, or merely as a novelty item. Note that the terms figure, figurine, ornamental figure, and ornamental figurine are used interchangeably herein.

DETAILED DESCRIPTION OF THE INVENTIONS

Figure 1:
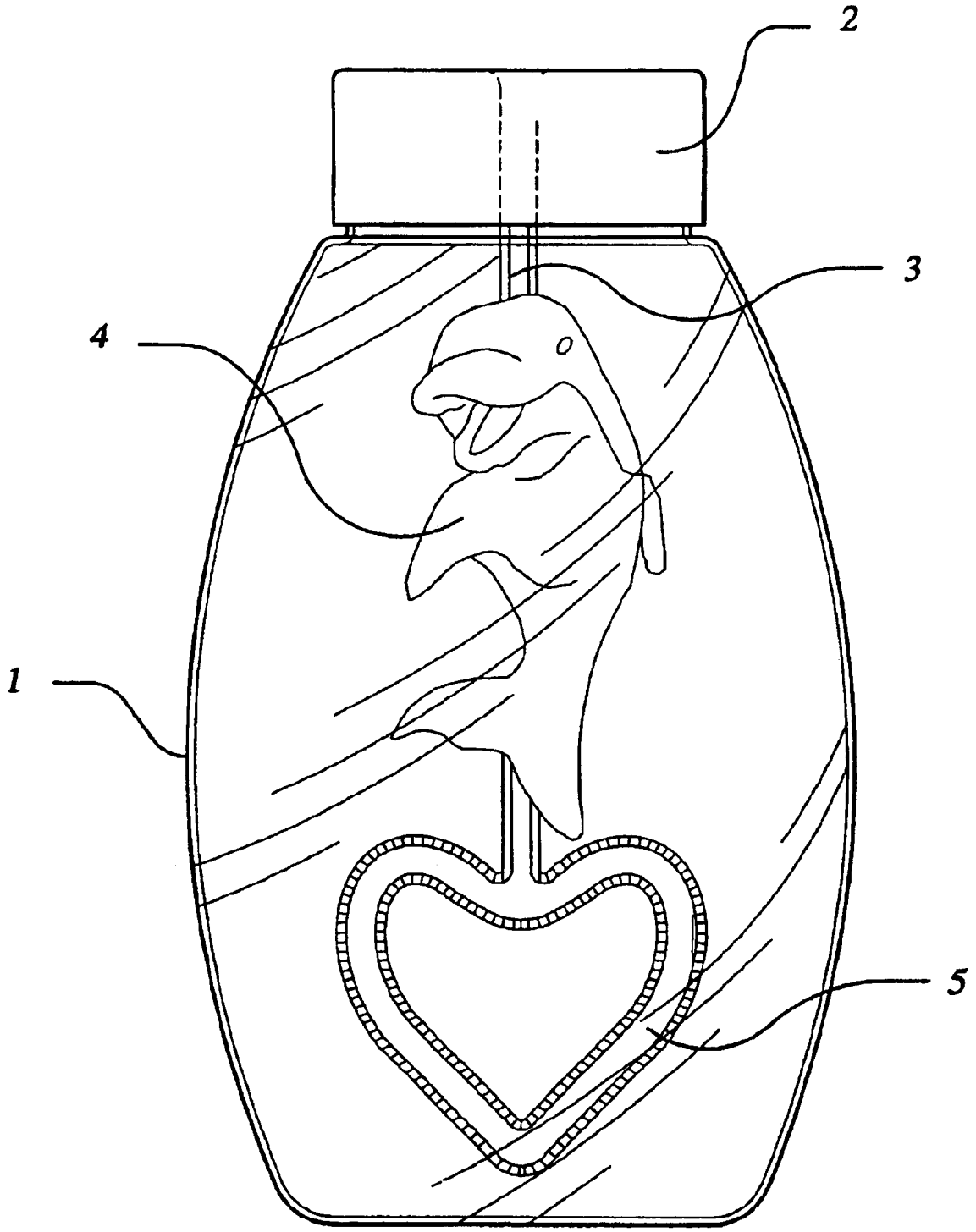
FIG. 1 shows a transparent container with a bubble wand shaft secured to the container cap, a three-dimensional ornamental figure attached to the shaft, and an ornamental bubble loop.
Figure 4:
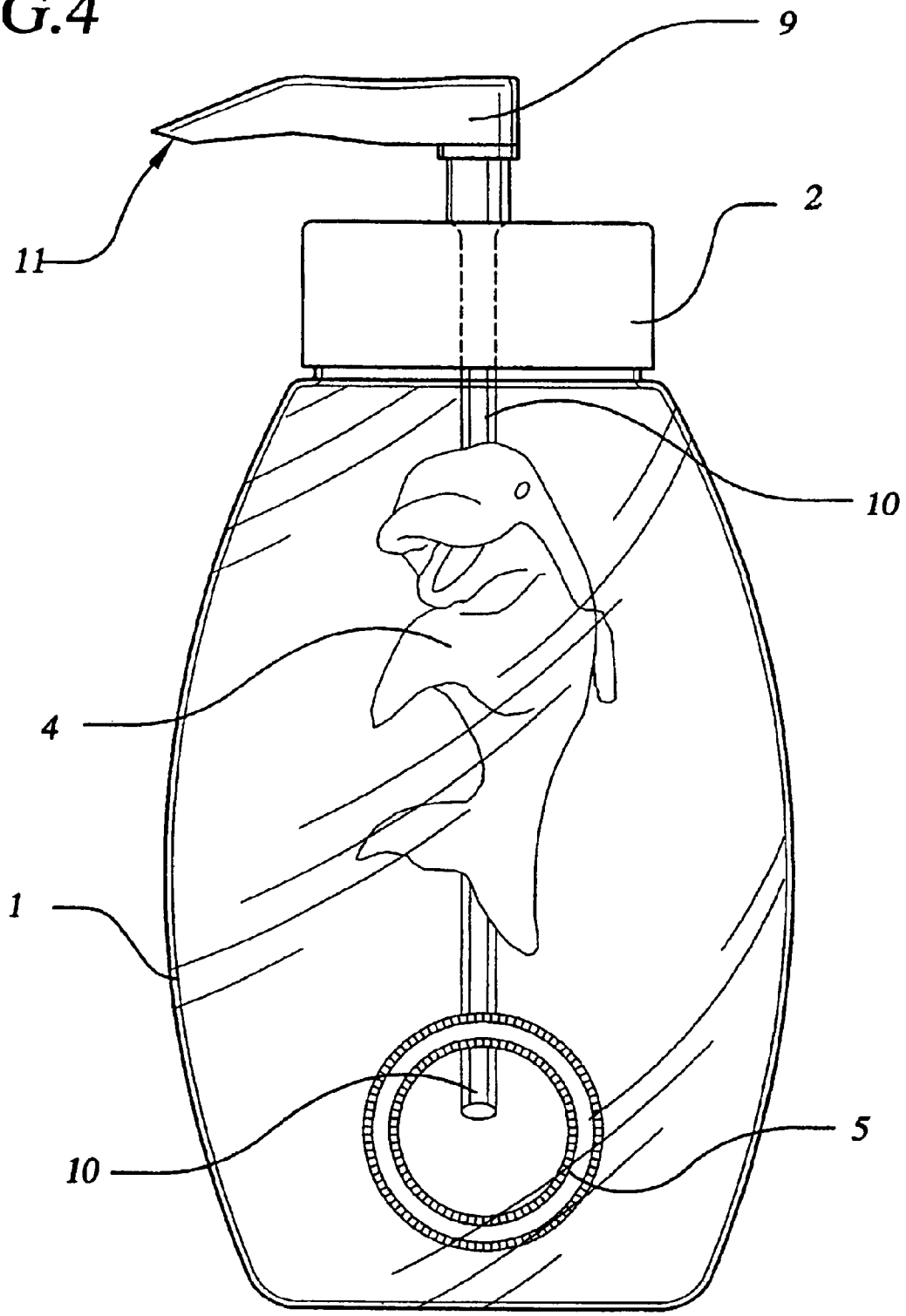
FIG. 4 shows a transparent container with a pump dispenser, a suction tube secured to the container cap, a three-dimensional ornamental figure attached to the suction tube, and a bubble loop attached to the suction tube.

FIG. 1 shows a container 1, a container cap 2 releasably attached to an opening in the container, a shaft 3 attached to the container cap, a three-dimensional ornamental FIG. 4 releasably attached to the shaft 3, and an ornamental bubble loop 5 attached to the shaft. Together the shaft 3 or shafts and any bubble loops 5 comprise a bubble wand. The container 1 is a bottle, cylinder, or other container capable of holding soap or other bubble mixture. The container may be transparent to show the fluid inside, as well as anything else held inside the bottle. However, the container may be opaque and be made into any shape, such as a character, plant, animal, geometrical design, or other design. The container cap 2, which has an inner surface and an outer surface (or a top and a bottom), comprises a securing means for securing the contents of the bottle. The container cap may be a cap, screw-on lid, flip-top lid, snap-top lid, dispensing tip, or other securing mechanism.

The shaft 3, ornamental FIG. 4, and loop 5 comprise a wand assembly, which may be sized and proportioned to fit inside the bubble mixture container. Although the wand assembly of FIG. 1 is attached to the container cap, the wand assembly may be loose within the container 1 or may be releasably or slidably attached to the comtainer cap. For example, the container cap 2 may be fitted with a receiving bore such that the wand assembly may be releasably or slidably attached to the receiving bore. A resilient seal would prevent leakage of the bubble mixture in the case of a slidable attachment.

The wand assembly components may be disposed about each other in different ways. The ornamental FIG. 4 may be releasably, fixedly, or slidably wrapped around the bubble wand 3 by a receiving bore, clip, glue, or other attachable or slidable means for attaching the figure to the wand. The shaft 3, loop 5, and the ornamental FIG. 4 may be separate from each other or from the container 1 or container cap 2. For example, the shaft and loop may be connected to each other (and together be free floating in the container) and the ornamental figure may be free-floating in the container. The bubble loop 5 may be releasably, fixedly, or slidably attached to the bubble wand. In addition, the bubble loop 5 may be formed as part of the ornamental figurine 4. For example, the bubble loop may be placed in the middle of the figurine or may be made a part of the figurine's face.

Figure 2:
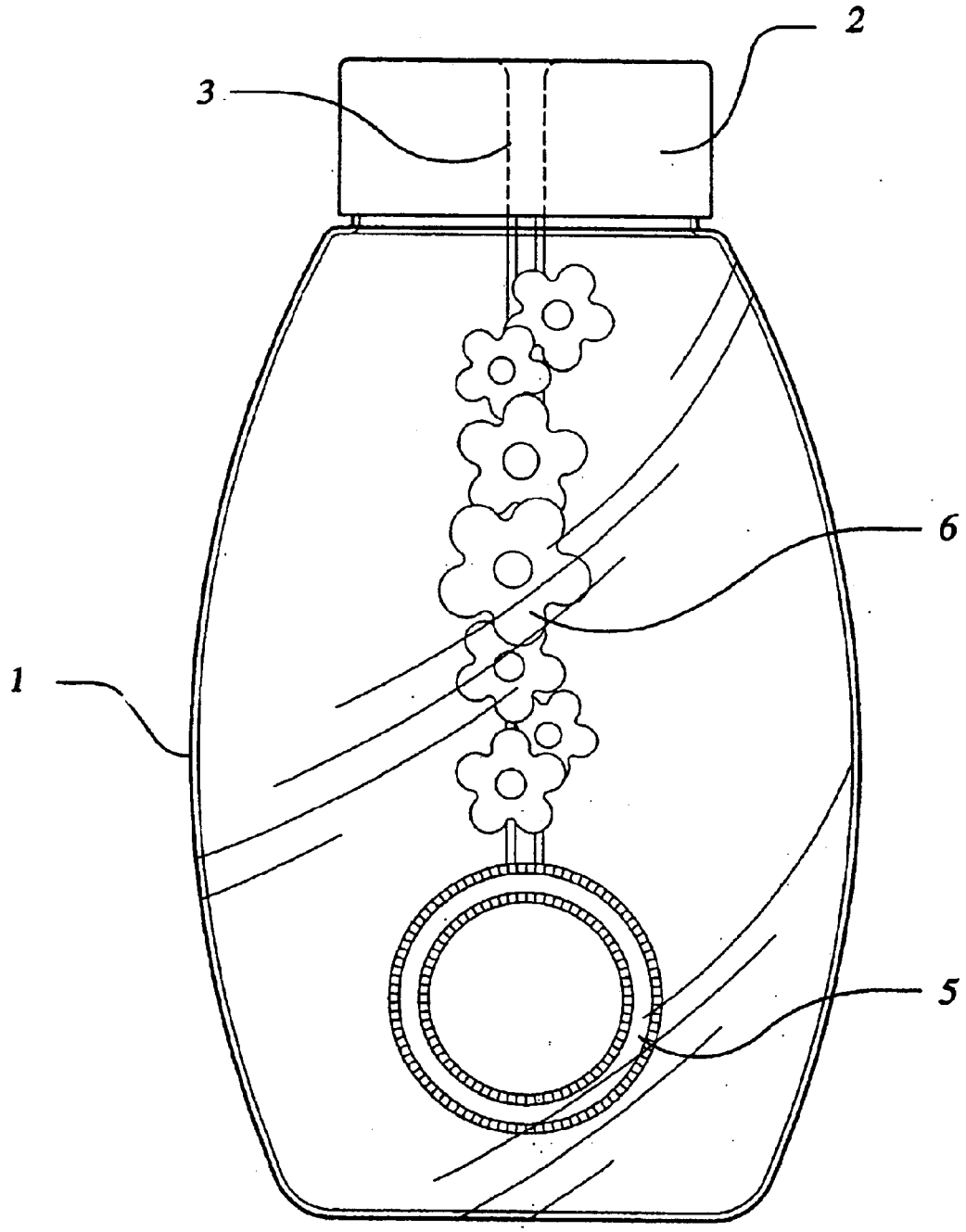
FIG. 2 shows a transparent container with a bubble wand shaft secured to the container cap, where the shaft comprises an ornamental figure.
Figure 3:
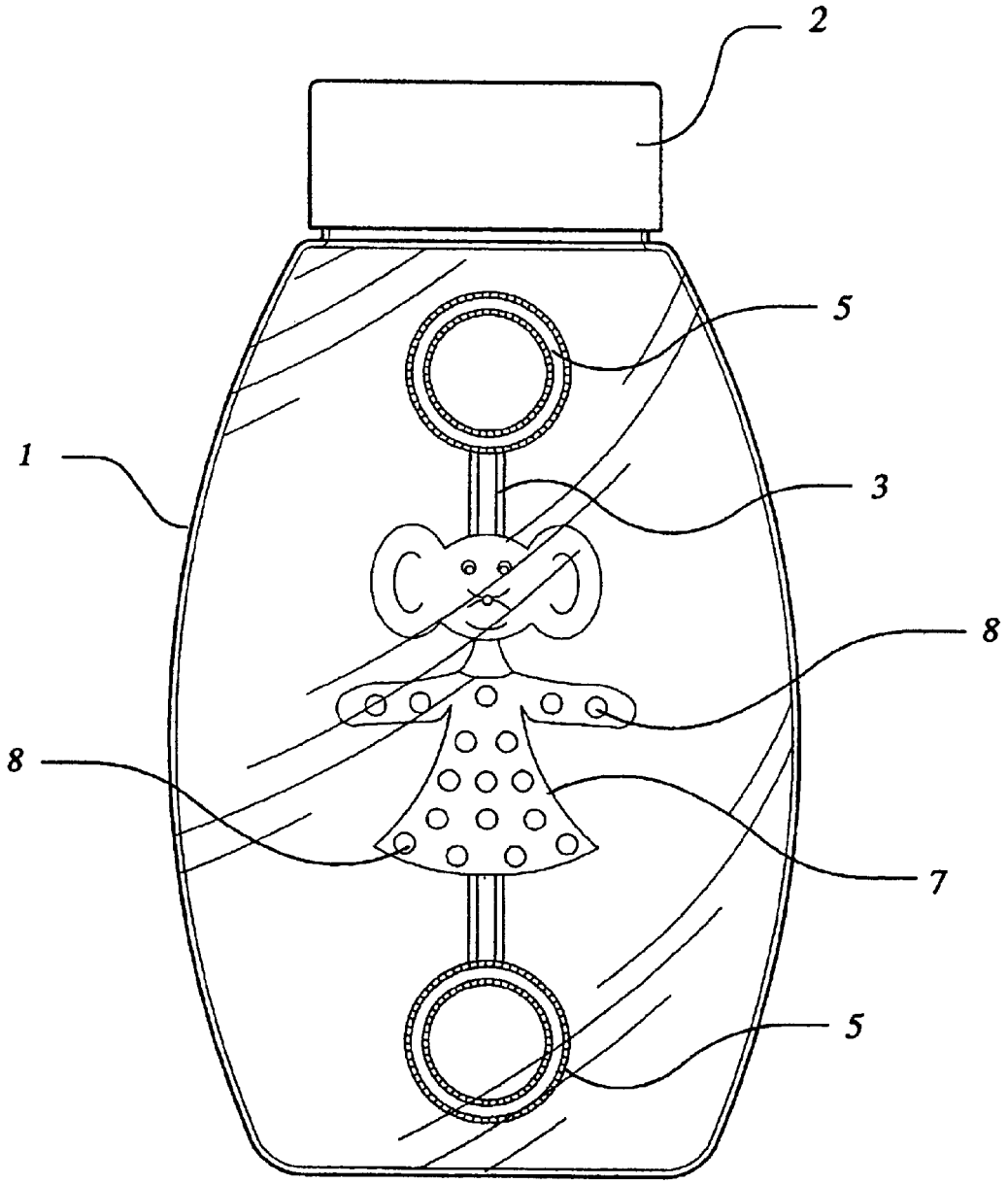
FIG. 3 shows a bubble wand disposed within a transparent container, a two-dimensional ornamental figure formed as a part of the bubble wand shaft, two bubble loops attached to the shaft, and a plurality of smaller bubble holes disposed in the ornamental figure.

The various parts of the wand assembly in FIG. 1 may be made in any form, such as a character, cartoon, action figure, animal, plant, pattern, set of beads, shapes, letters, or other attractive representation in the form of an ornamental figure. For example, in FIG. 1 the ornamental FIG. 4 is a whimsical representation of a dolphin and the bubble loop 5 is a whimsical representation of a heart. In another example, shown in FIG. 2, the shaft 3 is integrally fashioned into an ornamental pattern of flowers or beads 6. The shaft is securely attached to the inside of the container cap 2 and the bubble loop 5 is annular. In another example, shown in FIG. 3, a two-dimensional whimsical representation of a mouse 7 is formed as part of the shaft 3, which is free-floating in the container 1 (not attached to the cap 2). The wand has two larger annular bubble loops 5 and a plurality of smaller bubble holes 8 placed in the ornamental mouse 7. Thus, one may blow larger bubbles out of the two bubble loops 5 or may blow many smaller bubbles from the holes 8 in the ornamental mouse 7.

FIG. 4 shows a transparent container 1 with a pump dispenser 9, a suction tube 10 releasably attached to a dispenser cap 2 that is itself releasably attached to an opening in the container, an ornamental FIG. 4 releasably attached to the suction tube 10, and a bubble loop 5 attached to the suction tube 10. In the alternative, the suction tube 10 may be fixedly or slidably attached to the container cap 2, the ornamental FIG. 4 may be fixedly or slidably attached to the suction tube 10, and the bubble loop 5 may be releasably or slidably attached to the suction tube 10.

A dispensing tip 11 may be a dropper dispenser for use with bubble producing materials such as Softsoap® or other liquid soap. The dispensing tip is in fluid communication with the pump and the pump is in fluid communication with the suction tube 10 such that bubble mixture may be hand pumped from within the container to the dispensing tip. The suction tube 10 typically extends downward to the bottom of the container 1, and may be extra long so that it must bend to fit into the container. The suction tube 10 is typically a round or cylindrical tube, although it might have many different cross sections and resemble different characters, shapes, animals, plants, patterns, things, or other ornamental designs.

As with the embodiment in FIG. 1, the bubble loop 5 and ornamental FIG. 4 may comprise any ornamental shape, including two- or three-dimensional shapes, animals, plants, things, characters, geometric patterns, and other ornamental designs. Moreover, the materials of the wand assembly, pump, dispensing tip, cap, or bottle may be made from a material that glows in the dark.

Other versions of the bubble wand, figurine, and container are possible. For example, a separate ornamental figure and bubble loop may be attached to the top of the container cap in addition to the figure and bubble loop attached to the shaft. Such a bubble wand comprises a double-sided bubble wand. Thus, one can open the container cap, flip the container cap over, dip the top figurine into the bubble mixture, and use the cap figurine as a second bubble wand. In another embodiment, multiple figures may be placed on a single bubble wand or suction tube, with each figure rotatably attached to a central bar on the wand by means of a small loop on the bottom of each figure and each figure stacked behind the other. In addition, each figure may have both a bubble loop at the end of each figure and multiple bubble holes disposed in each figure. In another embodiment multiple figurines may be disposed directly on the bubble wand or suction tube. In addition, a wide cap may also be placed on the side of the container, (or on the top of a wide container) thus allowing for wide figurines and for wide bubble loops that can make large bubbles.

The various embodiments of the bubble wand with ornaments within a container may be packaged and marked to indicate their use as a bubble-making toy. Where the bubble mixture is soap, the embodiments should be packaged and marked to indicate its dual use as a bubble-making toy and as soap. The packages are displayed or placed so that prospective purchasers will find them with other bubble-making toys and with other soaps. Alternatively, the packages are placed by themselves or near unrelated products in order to generate more interest in the product. In addition, retailers may place associated displays, indicating the intended use of the various embodiments in proximity to the product, or elsewhere as a promotional display.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A toy suitable for making bubbles comprising:

a container having an opening;

a container cap releasably attached to the opening of the container;

a bubble wand, having a shaft connected to a bubble loop, wherein the bubble wand is disposed within the container and wherein the bubble wand is releasably attached to the container cap; and an ornamental figure attached to the bubble wand.

2. The toy of claim 1 wherein the bubble loop has an ornamental shape.

3. The toy of claim 1 wherein the shaft has an ornamental shape.

4. The toy of claim 1 wherein the container is filled with a bubble mixture.

5. The toy of claim 1 wherein the container is filled with a liquid soap suitable for producing bubbles.

6. The toy of claim 1 wherein the ornamental figure has the shape of a fish.

7. A toy suitable for making bubbles comprising:

a container having an opening;

a container cap releasably attached to the opening of the container;

a bubble wand, having a shaft connected to a bubble loop, wherein the bubble wand is disposed within the container and wherein the bubble wand is releasably attached to the container cap; and an ornamental figure fixedly attached to the bubble wand.

8. The toy of claim 7 wherein the bubble loop has an ornamental shape.

9. The toy of claim 7 wherein the shaft has an ornamental shape.

10. The toy of claim 7 wherein the container is filled with a bubble mixture.

11. The toy of claim 7 wherein the container is filled with a liquid soap suitable for producing bubbles.

12. The toy of claim 7 wherein the ornamental figure has the shape of a fish.

* * * * *